US010566149B2

(12) United States Patent
Wu et al.

(10) Patent No.: US 10,566,149 B2
(45) Date of Patent: Feb. 18, 2020

(54) LOCKING/UNLOCKING STRUCTURE OF A PUSHBUTTON SWITCH ACTUATOR

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Wen Bing Hsu, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 15/815,971

(22) Filed: Nov. 17, 2017

(65) Prior Publication Data

US 2018/0182572 A1 Jun. 28, 2018

(30) Foreign Application Priority Data

Dec. 22, 2016 (TW) ..... 105142681 A

(51) Int. Cl.

| | |
|---|---|
| ***H01H 3/20*** | (2006.01) |
| ***H01H 3/38*** | (2006.01) |
| ***H01H 9/28*** | (2006.01) |
| ***H01H 3/02*** | (2006.01) |
| ***H01H 3/16*** | (2006.01) |

(52) U.S. Cl.

CPC ..... *H01H 9/28* (2013.01); *H01H 3/022* (2013.01); *H01H 3/163* (2013.01); *H01H 3/20* (2013.01); *H01H 3/38* (2013.01); *H01H 2003/0246* (2013.01)

(58) Field of Classification Search

CPC .. H01H 9/20; H01H 9/24; H01H 3/20; H01H 2003/0246; H01H 9/28; H01H 3/38; H01H 3/163; H01H 3/022

USPC ..... 200/43.11, 341, 336

See application file for complete search history.

(56) References Cited

U.S. PATENT DOCUMENTS 7,094,982 B2 * 8/2006 Liu ..... H01H 19/63 200/11 J 8,513,557 B2 * 8/2013 Wahrenberg ..... H01H 3/022 200/329

* cited by examiner

*Primary Examiner* — Vanessa Girardi

(74) *Attorney, Agent, or Firm* — Rosenberg, Klein & Lee

(57) ABSTRACT

A locking/unlocking structure of switch device includes a main body and an operation button. The main body is formed with a first stop section and a second stop section. The main body defines a chamber, in which a reaction drum and a wire connection module are assembled. A first elastic unit is disposed between the reaction drum and the main body for making the reaction drum positioned in an initial assembling position, (where the wire connection module is in a closed-circuit state). The reaction drum is assembled with a restriction unit and a second elastic unit. When the reaction drum moves in response to the motion of the operation button, the second elastic unit will force the restriction unit to move from the first stop section to the second stop section so as to control the wire connection module into an open-circuit state.

20 Claims, 6 Drawing Sheets

LOCKING/UNLOCKING STRUCTURE OF A PUSHBUTTON SWITCH ACTUATOR

BACKGROUND OF THE INVENTION

1. Field of the Invention

The present invention relates generally to a locking/unlocking structure of switch device, and more particularly to a locking/unlocking structure of switch device, which includes an assembly of a main body, a reaction drum and a restriction unit. A first elastic unit is disposed between the main body and the reaction drum. A second elastic unit is disposed between the reaction drum and the restriction unit. By means of the first and second elastic units, an operator can operate the operation button with less strength. Also, the wear and loss of the components can be reduced.

2. Description of the Related Art

A conventional switch device is applied to an electrical, electronic and automatic control system for an operator to operate the machine or power on/off the system. Such switch device also can serve as an emergency switch. In the case that an operator improperly operates the machine or the equipment fails or the like, the operator can emergently open the circuit to power off the system so as to avoid serious damage or loss.

The conventional emergency switch device generally includes an operation button equipped with a pushbutton and/or rotary switch and a main body for receiving the operation button. A connection seat and a wire connection module are assembled in the main body. The main body is formed with multiple insertion blocks having double slopes. The connection seat is also formed with multiple insertion blocks having double slopes in adaptation to the insertion blocks of the main body. Multiple springs are assembled with the insertion blocks. When an operator presses the operation button to drive and press down the connection seat, the insertion blocks of the main body relatively force the insertion blocks of the connection seat to compress the springs. After the insertion blocks of the connection seat pass over the insertion blocks of the main body, the springs push out the insertion blocks of the connection seat to locate the same. Under such circumstance, the connection seat pushes and presses the wire connection module to open the circuit. Moreover, the operator can forcedly pull up the operation button and the connection seat, whereby the insertion blocks of the connection seat can pass through the insertion blocks of the main body and restore to their home assembling positions. In this case, the circuit of the wire connection module is closed again.

With respect to the structural design, operation and use of the above embodiment, in order to permit an operator to press or forcedly pull up the operation button and the connection seat, the insertion blocks of the main body and the insertion blocks of the connection seat are all formed with the structure of double slopes. Such structure will affect the security of the relative restriction and locating effect between the main body and the connection seat. As a result, the stability of the wire connection module in the open-circuit state is deteriorated.

In order to improve the above problem, another conventional switch device has been developed, in which the insertion blocks of the main body and the insertion blocks of the connection seat are formed with a structure of single slope. In this case, an operator can press the operation button and the connection seat, whereby after the insertion blocks of the connection seat pass through the insertion blocks of the main body, the connection seat can be located to push and press the wire connection module into the open-circuit state. In addition, by means of rotating the operation button and the connection seat, the insertion blocks of the connection seat can leave the insertion blocks of the main body, permitting the connection seat and the operation button to restore their home assembling positions, (whereby the circuit of the wire connection module is closed).

In the conventional switch device, the main body is formed with the insertion blocks (with single slope or double slopes) and the connection seat is also formed with the insertion blocks (with single slope or double slopes). The springs are cooperatively assembled with the insertion blocks. However, in fact, as well known by those who are skilled in this field, a greater resistance exists in such structure. The resistance includes the action force between the slopes of the insertion blocks of main body and the slopes of the insertion blocks of the connection seat and the reaction force of the springs. The operation force of an operator must be greater than the force for pushing away the slopes of the insertion blocks of main body, which overlap the slopes of the insertion blocks of the connection seat, and overcome the reaction force of the springs. Therefore, the operator needs to apply a greater operation force to overcome the resistance. Also, in order to make the insertion blocks of the connection seat truly pass through the insertion blocks of the main body, in practice, the operator will instinctively increase the operation force. This is not what we expect.

Still with respect to the structural design, the components of the operation button, the connection seat, the wire connection module, etc. are all mounted in the narrow internal space of the main body. In addition, each of main body and the connection seat is formed with multiple insertion blocks. Furthermore, multiple cooperative (transverse) springs are assembled with the insertion blocks (in a direction normal to the axis of the main body or the axis of the connection seat). This obviously increases the difficulty in assembling these components.

Moreover, when an operator applies an operation force to force the insertion blocks of the connection seat to squeeze and pass through the insertion blocks of the main body, the components are apt to wear. In addition, the difference between the action force between the cooperative insertion blocks of the main body and the insertion blocks of the connection seat and the different wear extents of the respective insertion blocks will both affect the true positions of the operation button and the connection seat. As a result, the operation button and the connection seat can hardly keep in the central position. Under such circumstance, the stability of the contacts of the operation button, the connection seat and the wire connection module in the turn-on state will be deteriorated and the quality of the entire emergency switch device will be lowered.

To speak representatively, the above references reveal some shortcomings of the main body, the connection seat and the relevant connection components of the conventional switch device in use and structural design. In case the main body, the operation button, the connection seat and the relevant components are redesigned to be different from the conventional switch device, the use form of the switch device can be changed to widen the application range thereof. For example, in the condition that the structure is simplified and the operation is facilitated, the redesign must include the following issues:

1. The structural characteristic and operation form of the conventional switch device that the main body is formed with the insertion blocks and/or the springs and the connection seat is formed with the insertion blocks and/or the springs must be eliminated. In this case, an operator no more needs to apply a greater operation force to overcome the resistance of the cooperative insertion block structures. Also, the operation will not instinctively increase the operation force for making the insertion blocks of the connection seat truly pass through the insertion blocks of the main body.

2. The problems of the conventional switch device that the complicated cooperative structures of the insertion blocks, the (transverse) springs, etc. are assembled in the narrow internal space of the main body and the difficulty in assembling the components is increased should be improved. In addition, the conventional switch device has the problems that the conventional cooperative structures and components are apt to wear and the difference between the action force between the cooperative insertion blocks and the different wear extents of the respective insertion blocks will both affect the true positions of the operation button and the connection seat so that the operation button and the connection seat can hardly keep in the central position. Under such circumstance, the stability of the contacts of the operation button, the connection seat and the wire connection module in the turn-on state will be deteriorated and the quality of the entire emergency switch device will be lowered. All these problem need to be improved.

All the above issues are not substantially taught, suggested or disclosed in the above references.

SUMMARY OF THE INVENTION

It is therefore a primary object of the present invention to provide a locking/unlocking structure of switch device, which can reduce the room occupied by the components and simplify the components and lower the wear and loss of the components. The switch device includes a main body and an operation button disposed on the main body. The main body is defined with a reference axis. The main body is formed with at least one first stop section and at least one second stop section. The main body defines a chamber. A reaction drum and a wire connection module are assembled in the chamber. A first elastic unit is disposed between the reaction drum and the main body for making the reaction drum positioned in an initial assembling position, (where the wire connection module is in a closed-circuit state). The reaction drum is assembled with a restriction unit and a second elastic unit. When the reaction drum moves in response to the motion of the operation button, the second elastic unit will force the restriction unit to move from the position of the first stop section into the position of the second stop section so as to control the wire connection module into an open-circuit state. This improves the shortcomings of the conventional switch device that the operator needs to apply a greater operation force to overcome the resistance and the stability of the structure is relatively poor.

In the above locking/unlocking structure of switch device, each of the first and second elastic units has a first end and a second end. The first elastic unit is annularly disposed between the chamber of the main body and the reaction drum. The first end of the first elastic unit is assembled with the reaction drum. The second end of the first elastic unit is affixed to the main body or the chamber. The second elastic unit is wound on the reaction drum. The first end of the second elastic unit is affixed to the reaction drum. The second end of the second elastic unit is assembled with the restriction unit.

Therefore, when the reaction drum or the restriction unit is positioned in the position of the first stop section or the initial assembling position, (where the wire connection module is in the closed-circuit state), the first elastic unit is in a compressed state (or the second elastic unit is also slightly compressed). In addition, when the reaction drum is rotated by a certain angle (such as 45° ~90°) in a set direction, (which is a clockwise direction or a counterclockwise direction with the reference axis serving as a reference base), the first elastic unit will store energy to produce torque. In addition, via the second elastic unit, the reaction drum drives the restriction section to rotate, whereby the second elastic unit also stores energy to provide torque. When an operator presses the operation button, the first elastic unit is compressed and the second elastic unit (and/or the first elastic unit) release the previously stored torque or twisting energy, whereby the restriction unit is rotated back to move to the position of the second stop section of the main body. Under such circumstance, the wire connection module is in the open-circuit state.

When the operator rotates the operation button to drive the reaction drum to again rotate by a certain angle in the set direction (to drive and twist the first elastic unit), via the second elastic unit, the reaction drum drives the restriction unit to also rotate in the set direction, whereby restriction unit leaves the second stop section. Cooperatively, the previously compressed first elastic unit releases part of the energy to make the reaction drum and the restriction unit move back to the initial assembling position or the position of the first stop section, (where the wire connection module is in the closed-circuit state). At this time, the second elastic unit also stores torque (in a slightly compressed state).

The present invention can be best understood through the following description and accompanying drawings, wherein:

DETAILED DESCRIPTION OF THE PREFERRED EMBODIMENTS

Figure 1:
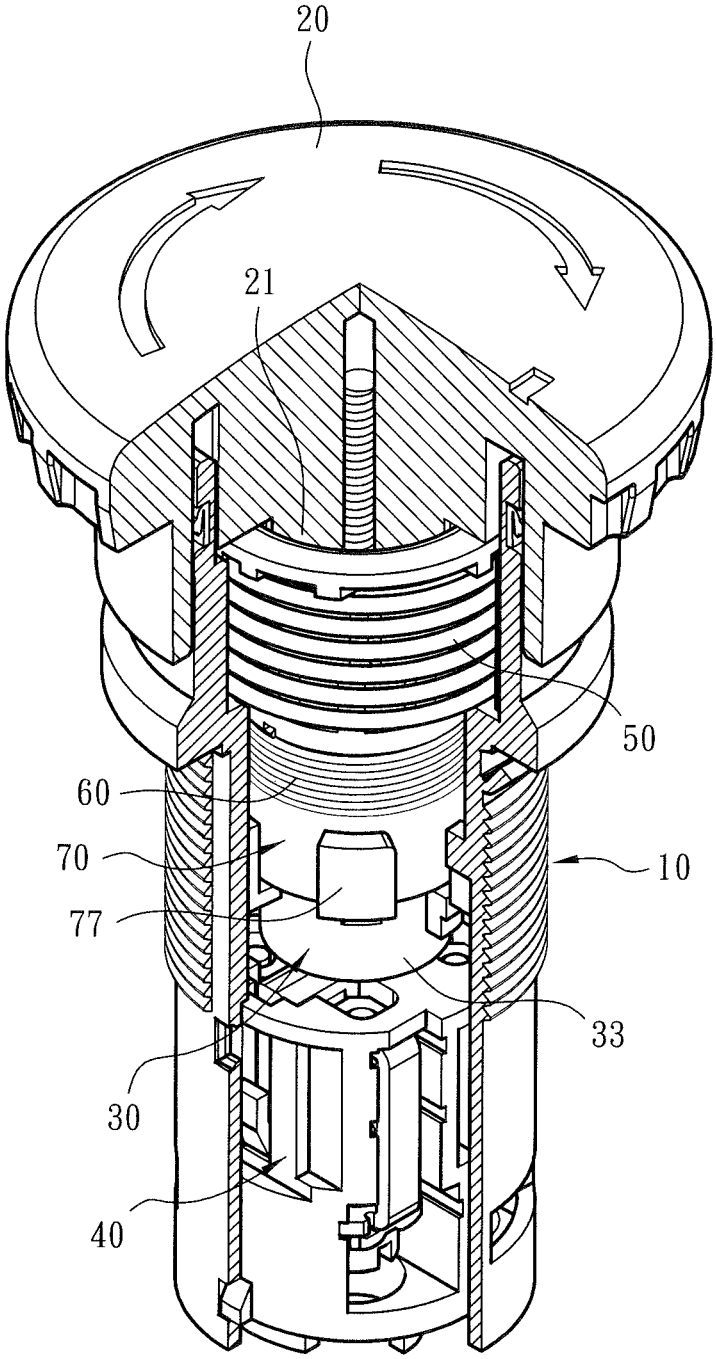
FIG. 1 is a perspective sectional view of the present invention, showing the structure of the assembly of the operation button, the main body, the reaction drum, the first elastic unit, the restriction unit and the second elastic unit of the present invention.
Figure 2:
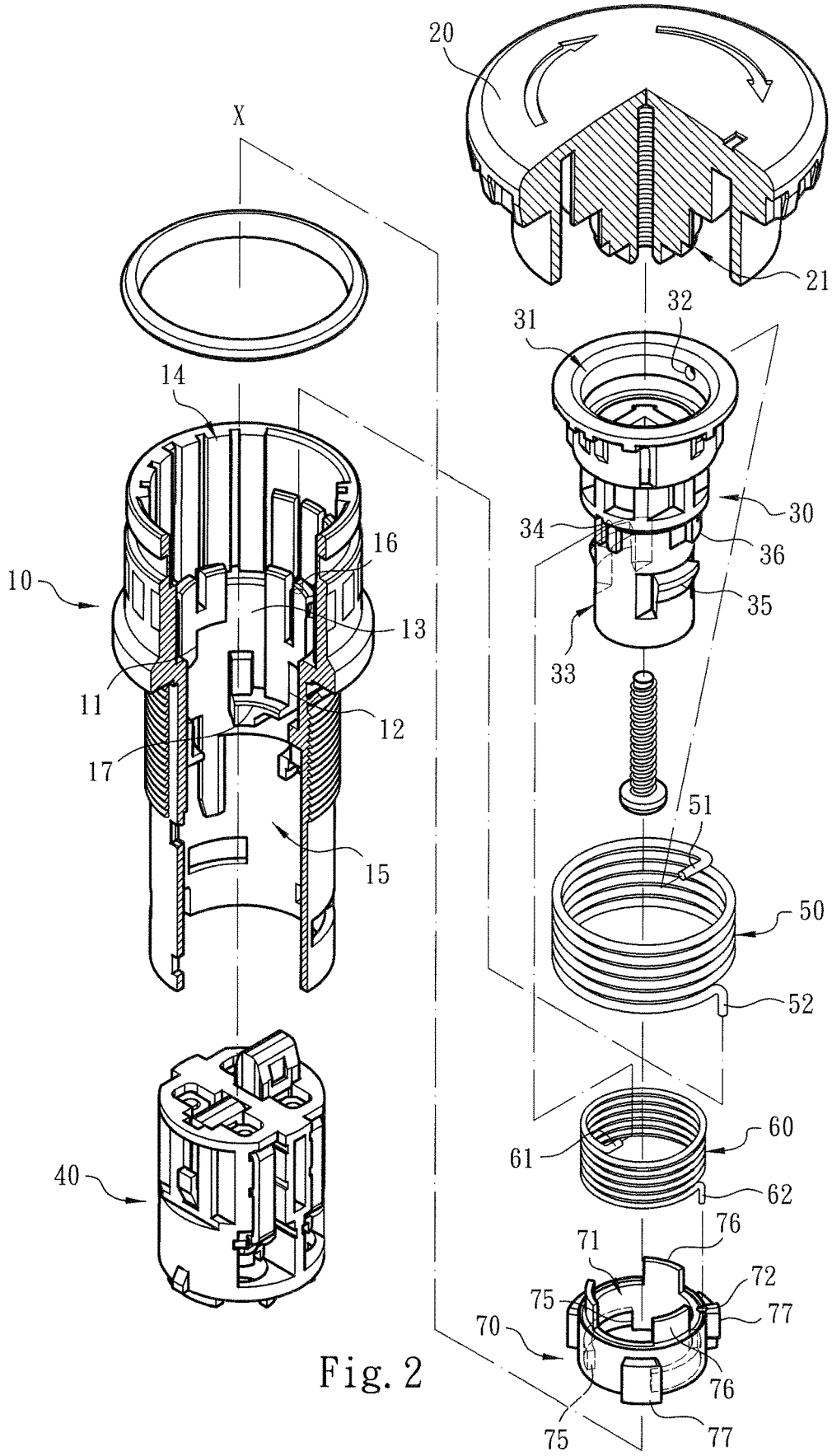
FIG. 2 is a perspective exploded view according to FIG. 1.
Figure 2A:
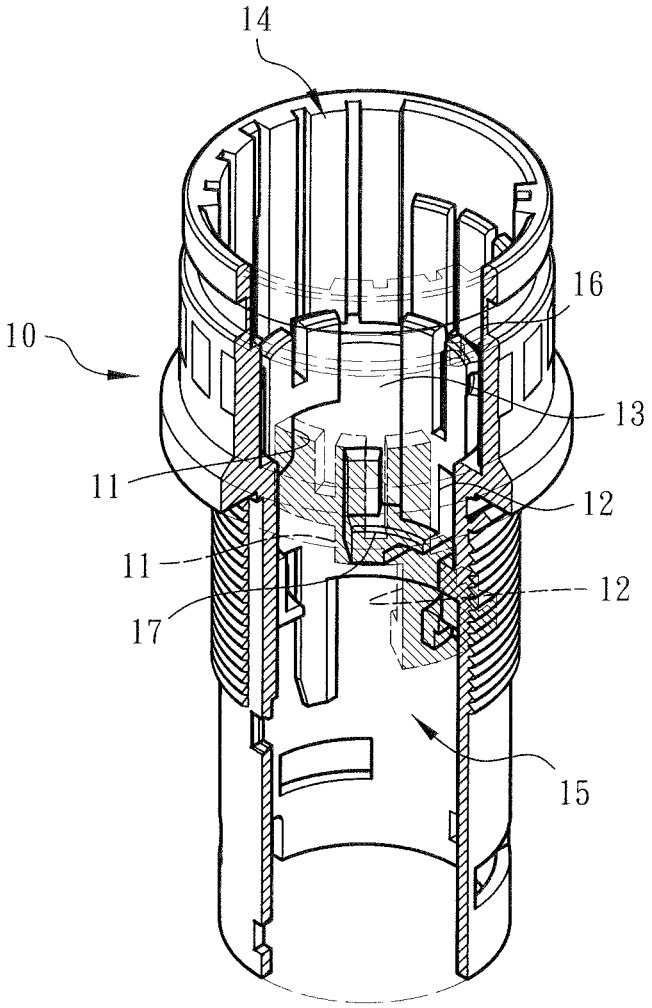
Figure 3:
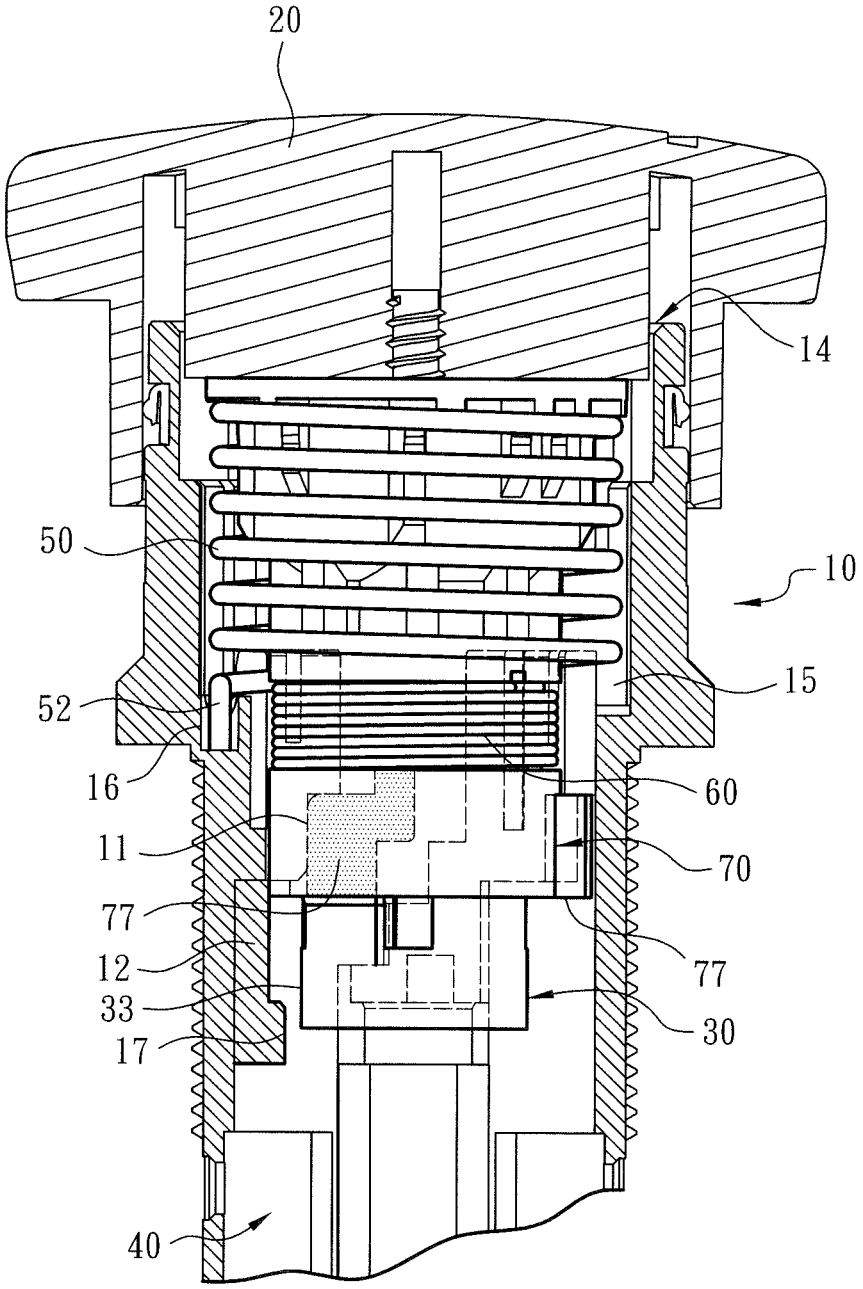
FIG. 3 is a plane sectional view of the present invention according to FIG. 1, showing that the restriction unit is cooperatively assembled with the reaction drum and positioned in the position of the first stop section or the initial assembling position.

Please refer to FIGS. 1, 2 and 3. The locking/unlocking structure of switch device of the present invention includes a main body 10. The main body 10 is a cylindrical structure made of insulation material. The main body 10 is defined with a reference axis X. The main body 10 defines an assembling hole 14 and a chamber 15 in communication with the assembling hole 14. An operation button 20 is disposed in the main body 10 or the assembling hole 14. The operation button 20 is permitted to freely move and/or rotate within the main body 10 along the reference axis X.

In this embodiment, at least one or multiple first stop section 11 and a second stop section 12 adjacent to the first stop section 11 are disposed in the main body 10 or the chamber 14. According to the position in the drawing, the first stop section 11 is positioned above the second section 12. The first and second stop sections 11, 12 are in the form of protruding board structure to define a passage 13 on the main body 10 in adjacency to the first stop section 11 and/or the second stop section 12.

As shown in the drawings, a reaction drum 30 and a wire connection module 40 are assembled in the chamber 15 of the main body 10. Via the operation of the reaction drum 30, the operation button 20 can control the wire connection module 40 into a closed-circuit state or an open-circuit state. The reaction drum 30 is formed with a pivotal connection hole 31. A drive section 21 of the operation button 20 is pivotally connected in the pivotal connection hole 31, whereby the operation button 20 can drive the reaction drum 30 to move. In addition, the reaction drum 30 is formed with a hole 32 positioned in a position where the pivotal connection hole 31 is positioned and a belly section 33 downward extending along the pivotal connection hole 31. The belly section 33 is formed with a hole 34 and at least one or multiple restriction sections 35 in the form of protruding structure.

In this embodiment, a first elastic unit 50 is disposed between the reaction drum 30 and the main body 10. The first elastic unit 50 has a first end 51 and a second end 52. That is, the first elastic unit 50 is annularly disposed between the chamber 15 of the main body 10 and the reaction drum 30. The first end 51 of the first elastic unit 50 is assembled in the hole 32 of the reaction drum 30, while the second end 51 is affixed in a recess 16 of the main body 10 or the chamber 15.

As shown in the drawings, a second elastic unit 60 and a restriction unit 70 are assembled on the reaction drum 30 or the belly section 33. The second elastic unit 60 is wound on the belly section 33 of the reaction drum 30. The second elastic unit 60 has a first end 61 and a second end 62. The first end 61 of the second elastic unit 60 is affixed to the hole 34 of the reaction drum 30, while the second end 62 is assembled with the restriction unit 70. When the reaction drum 30 moves in response to the motion of the operation button 20, the second elastic unit 60 will force the restriction unit 70 to move from the position of the first stop section 11 into the position of the second stop section 12 (or from the position of the second stop section 12 into the position of the first stop section 11) so as to control the wire connection module 40 into an open-circuit state (or a closed-circuit state).

To speak more specifically, the restriction unit 70 is formed with a shaft hole 71, whereby the restriction unit 70 can be fitted on the reaction drum 30 or the belly section 33 and rotated around the reaction drum 30. The restriction unit 70 is formed with a dent 72 positioned in a position where the shaft hole 71 is positioned for fixing the second end 62 of the second elastic unit 60. In addition, the restriction unit 70 includes at least one or multiple restriction sections 75 formed in the restriction unit 70 or on the shaft hole 71. The restriction sections 75 are cooperatively engaged with the restriction sections 35 of the reaction drum 30 to limit the rotational angle of the restriction unit 70 within a certain range and prevent the reaction drum 30 and the restriction unit 70 from axially detaching from each other.

In a preferred embodiment, the restriction unit 70 is further formed with a protruding subsidiary restriction section 76. The subsidiary restriction section 76 cooperates with a subsidiary restriction section 36 of the reaction drum 30 to help in limiting the rotational angle of the restriction unit 70 within a certain range.

As shown in FIGS. 1, 2 and 3, at least one or multiple stop sections in the form of protruding structure are disposed on outer circumference of the restriction unit 70. The stop sections 77 can cooperatively move into or out of the first stop section 11 and/or the second stop section 12 of the main body 10 so as to control the wire connection module 40 into a closed-circuit state or an open-circuit state.

In this embodiment, when assembling the (emergency) switch device, with the reference axis X serving as a reference direction, with the second end 52 of the first elastic unit and the recess 16 of the main body 10 serving as a fulcrum, the reaction drum 30 is rotated by an angle (such as 90° ~100°) in a set direction (such as clockwise). At this time, the first elastic unit 50 stores energy to produce torque. In addition, the restriction section 35 and/or the subsidiary restriction section 36 of the reaction drum 30 push the restriction section 75 and/or the subsidiary restriction section 76 of the restriction unit 70, whereby the stop section 77 of the restriction unit 70 is driven to rotate to the position of the passage 13 of the main body 10. Accordingly, the reaction drum 30, the restriction unit 70, the first elastic unit 50 storing the energy and the second elastic unit 60 are installed into the chamber 15 of the main body.

In a preferred embodiment, the reaction drum 30 can cooperatively employ the second elastic unit 60 to drive and rotate the stop section 77 of the restriction unit 70 to the position of the passage 13 of the main body 10.

Please refer to FIG. 3. After the external assembling force disappears, the first elastic unit 50 releases part of the twisting energy and the reaction drum 30 is counterclockwise rotated back by a certain angle (such as) 30° ~45°, whereby the stop section 77 of the restriction unit 70 is positioned in the position of the first stop section 11 of the main body or an initial assembling position (or a position where the wire connection module is in the closed-circuit state). At this time, the first elastic unit 50 is in a compressed state (or the second elastic unit is also slightly compressed). In addition, the first elastic unit 50 still store part of the torque or the twisting energy and the second elastic unit 60 is also in a torque-storing or twisting energy-storing state. As aforesaid, the first elastic unit 50 will release part of the twisting energy (to make the reaction drum 30 counterclockwise rotate back by a certain angle). When an operator operates and presses the operation button 20 (or the reaction drum 30 and the restriction unit 70), this will reduce the frictional force between the stop section 77 of the restriction unit and the first stop section 11 of the main body. Accordingly, the operation can operate with less strength.

Therefore, the cooperative structural form of the main body 10, the reaction drum 30 and the first elastic unit 50 provides a (security) back-rotational system or range for the reaction drum 30 and the first elastic unit 50.

Figure 4:
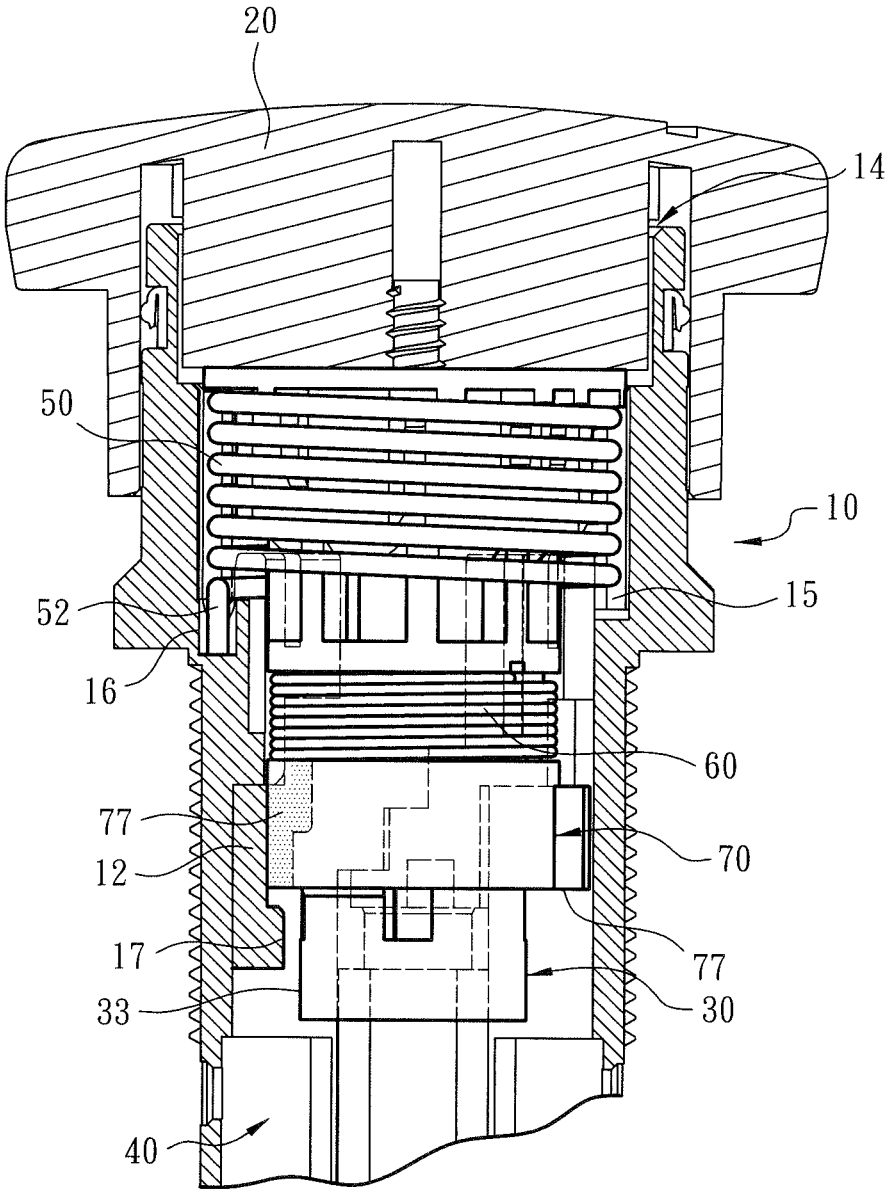
FIG. 4 is a plane sectional view of the present invention, showing that the operation button is pressed down and the restriction unit is rotated back into the position of the second stop section of the present invention.

Please now refer to FIG. 4. In case of emergency, after an operator presses the operation button 20 (to compress the first elastic unit 50), the stop section 77 of the restriction unit 70 is moved toward lower side of the drawing to leave the first stop section 11 of the main body. At this time, the second elastic unit 60 releases the previously stored twisting energy to make the restriction unit 70 rotate back to drive the stop section 77 to enter the position of the second stop section 12 of the main body. In this case, the wire connection module 40 is in the open-circuit state.

Preferably, in adaptation to the position or angle of the first and second stop sections 11, 12 positioned on the main body 10, the first elastic unit 50 can release the previously stored part of the twisting energy to make the reaction drum 30 rotate back from the aforesaid 45° position or 60° position by a set angle (such as 10°~15°).

In the above pressing operation, in order to prevent the reaction drum 30 and the restriction unit 70 from being over-pressed into the main body 10, the main body 10 or the chamber 15 is formed with stop section 17 in the form of protruding structure. The stop section 17 is connected under the second stop section 12 in the drawing. The protruding length of the stop section 17 is larger than the first stop section 11 or the second stop section 12 for limiting the moving distance of the reaction drum 30 or the restriction unit 70.

Figure 5:
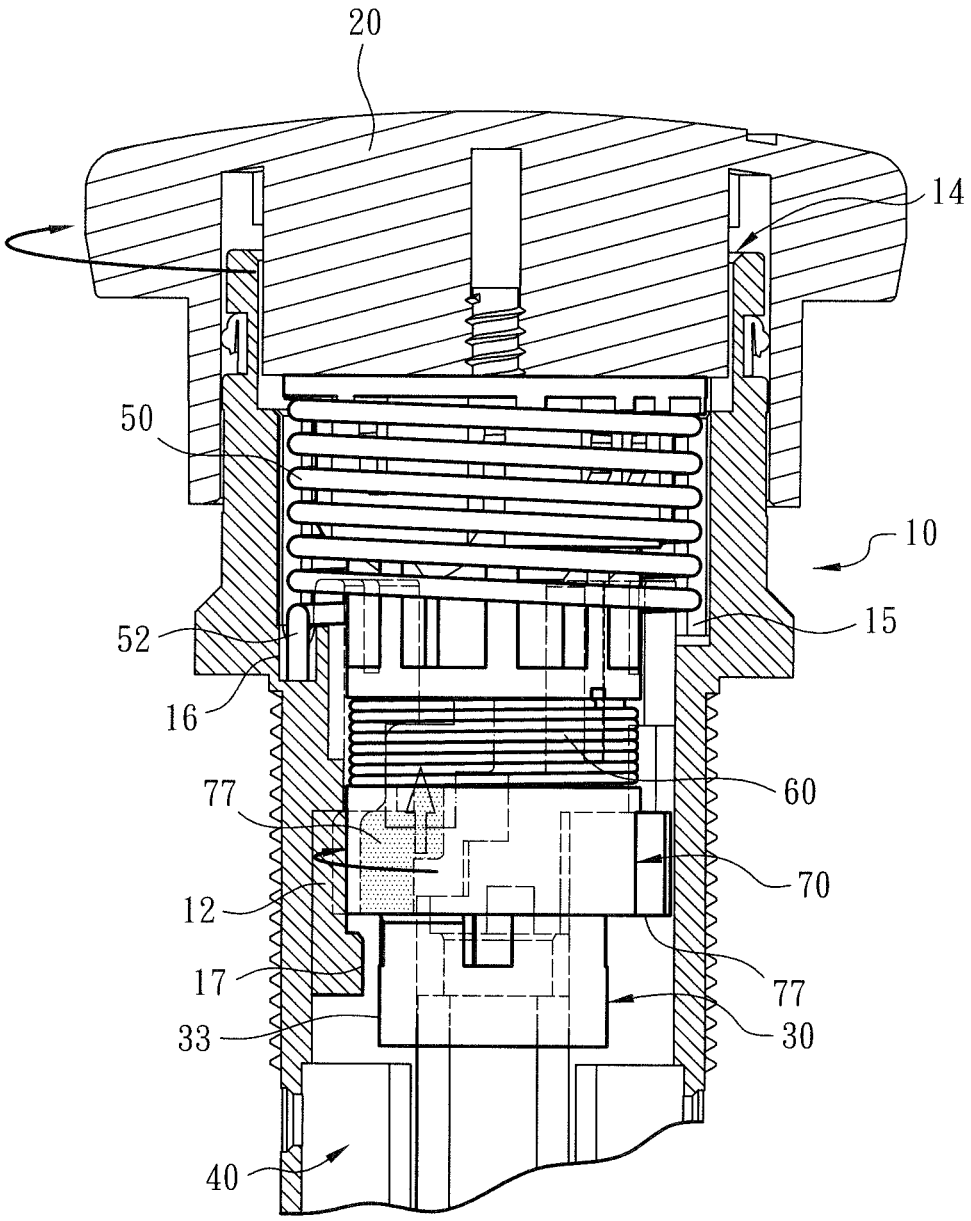
FIG. 5 is another plane sectional view of the present invention, showing that the operation button drives the reaction drum to rotate in a first direction and the reaction drum drives the restriction unit to rotate in the first direction, whereby the restriction unit leaves the second stop section to move toward the initial assembling position or the position of the first stop section.

Please now refer to FIG. 5. When the operator rotates the operation button 20 clockwise by an angle (such as 15° ~45°), the restriction section 35 and/or the subsidiary restriction section 36 of the reaction drum 30 push the restriction section 75 and/or the subsidiary restriction section 76 (or the second elastic unit 60) of the restriction unit 70, so that the reaction drum 30 drives the restriction unit 70 to also rotate clockwise, whereby the stop section 77 leaves the position of the second stop section 12 of the main body. Cooperatively, the previously compressed first elastic unit 50 releases part of the energy to make the stop section 77 of the restriction unit move into the position of the first stop section 11 of the main body and move back to the initial assembling position, (where the wire connection module 40 is in the closed-circuit state). At this time, the first elastic unit 50 can release part of the previously stored twisting energy.

As aforesaid, the first elastic unit 50 can release part of the stored torque (or energy) to drive the reaction drum 30 to rotate back by a certain angle. This helps in positioning the stop section 77 of the restriction unit in the position of the first stop section 11 of the main body.

It should be noted that in comparison with the conventional switch device in which the insertion blocks of the connection seat are forcedly pressed to squeeze and pass over the insertion blocks of the main body and the resistance includes the action force between the insertion blocks and the reaction force of the springs, when an operator presses the operation button 20, the second elastic unit 60 can release the stored energy, whereby the stop section 77 of the restriction unit can automatically insert into the second stop section 12 of the main body to complete the open-circuit mode of the wire connection module 40. Obviously, the operator can save the operation force and the operation is facilitated.

To speak representatively, in the condition that the structure is simplified and the operation is facilitated, in comparison with the conventional switch device, the locking/unlocking structure of switch device of the present invent ion has the following advantages:

1. The main body 10 and the reaction drum 30 and the relevant cooperative structures have been redesigned in use and operation form to be different from the conventional switch device. For example, the main body 10 or the chamber 15 is formed with the first stop section 11, the second stop section 12 and the passage 13. The first elastic unit 50 is disposed between the main body 10 and the reaction drum 30. The reaction drum 30 is formed with the restriction section 35 or the subsidiary restriction section 36. The restriction unit 70 is cooperatively assembled with the belly section 33 of the reaction drum. The restriction unit 70 is formed with the restriction section 75 and/or the subsidiary restriction section 76. The second elastic unit 60 is disposed between the reaction drum 30 and the restriction unit 70. The restriction unit 70 is formed with the stop section 77 in response to the motion of the reaction drum 30 and the first and second elastic units 50, 60 storing or releasing the energy. Obviously, the structural characteristic and operation form of the conventional switch device that the main body is formed with the insertion blocks and/or the springs and the connection seat is formed with the insertion blocks and/or the springs are eliminated.
2. The structural form of the present invention that the first and second stop sections 11, 12 of the main body cooperate with the reaction drum 30, the restriction unit 70 and the first and second elastic units 50, 60 improves the shortcomings of the conventional switch device that the operator needs to apply a greater operation force to overcome the resistance of the cooperative structures of the insertion blocks and in order to make the insertion blocks of the connection seat truly pass through the insertion blocks of the main body, the operator will instinctively increase the operation force.
3. The structural form of the present invention that the first and second stop sections 11, 12 of the main body cooperate with the reaction drum 30, the restriction unit 70 and the first and second elastic units 50, 60 also obviously improves the shortcomings of the conventional switch device that the complicated cooperative structures of the insertion blocks, the (transverse) springs, etc. are assembled in the narrow internal space of the main body and the difficulty in assembling the components is increased. In addition, the structural form of the present invention obviously improves the shortcomings of the conventional switch device that the conventional cooperative structural form often leads to wear of the components and the difference between the action force between the cooperative insertion blocks and the different wear extents of the respective insertion blocks will affect the true positions of the operation button and the connection seat so that the operation button and the connection seat can hardly keep in the central position. Under such circumstance, the stability of the contacts of the operation button, the connection seat and the wire connection module in the turn-on state will be deteriorated and the quality of the entire emergency switch device will be lowered.

In conclusion, the locking/unlocking structure of switch device of the present invention is effective and different from the conventional terminal device in space form. The locking/unlocking structure of switch device of the present invention is inventive, greatly advanced and advantageous over the conventional switch device.

The above embodiments are only used to illustrate the present invention, not intended to limit the scope thereof. Many modifications of the above embodiments can be made without departing from the spirit of the present invention.

What is claimed is:

1. A locking/unlocking structure of switch device, comprising: a main body having a reference axis extending axially therethrough, the main body including an assembling hole and a chamber in communication with the assembling hole, the main body being formed with at least one first stop section and at least one second stop section, a reaction drum assembled in the chamber of the main body, a first elastic unit disposed about the reaction drum, the reaction drum being assembled with a restriction unit and a second elastic unit, and responsive to movement of the reaction drum, the restriction unit is at least movable between the first stop section and the second stop section;

wherein the main body, the reaction drum, and the restriction unit are positioned in an assembling position, a stop section of the restriction unit being correspondingly positioned relative to the first stop section of the main body, the first elastic unit being in a compressed state, and the first and second elastic units respectively providing a torque.

2. A locking/unlocking structure of switch device, comprising: a main body having a reference axis extending axially therethrough, the main body including an assembling hole and a chamber in communication with the assembling hole, the main body being formed with at least one first stop section and at least one second stop section, a reaction drum assembled in the chamber of the main body, a first elastic unit disposed about the reaction drum and providing a torque thereto, the reaction drum being rotatable about the reference axis and assembled with a restriction unit, a second elastic unit coupling the reaction drum to the restriction unit, the restriction unit being rotatable about the reference axis, and responsive to movement of the reaction drum, the restriction unit being movable at least between the first stop section and the second stop section according to a torque provided by the second elastic unit.

3. The locking/unlocking structure of switch device as claimed in claim 2, wherein the restriction unit is further formed with a protruding subsidiary restriction section cooperating with a subsidiary restriction section of the reaction drum to together limit a rotational angle of the restriction unit within a certain range, the main body being formed with a protruding stop section positioned under the second stop section, and the protruding stop section extending toward the reference axis to a greater extent than either of the first and second stop sections.

4. The locking/unlocking structure of switch device as claimed in claim 2, wherein the reaction drum is formed with at least one restriction section, the restriction unit including at least one restriction section for engaging with the restriction section of the reaction drum, at least one protruding stop section being disposed on an outer circumference of the restriction unit.

5. The locking/unlocking structure of switch device as claimed in claim 4, wherein the restriction unit is further formed with a protruding subsidiary restriction section cooperating with a subsidiary restriction section of the reaction drum to together limit a rotational angle of the restriction unit within a certain range, the main body being formed with a protruding stop section positioned under the second stop section, the protruding stop section extending toward the reference axis to a greater extent than either of the first and second stop sections.

6. The locking/unlocking structure of switch device as claimed in claim 2, wherein multiple first stop sections and multiple second stop sections are formed in the main body and multiple passages in adjacency to at least one of the first and second stop sections are disposed in the chamber of the main body, each of the first stop sections being positioned closer to the assembling hole than a respective adjacent one of the second stop sections, each of the first and second elastic units having a first end and a second end, the first end of the first elastic unit being assembled with the reaction drum, the second end of the first elastic unit being affixed to the main body, the first end of the second elastic unit being affixed to the reaction drum, the second end of the second elastic unit being assembled with the restriction unit.

7. The locking/unlocking structure of switch device as claimed in claim 6, wherein the restriction unit is further formed with a protruding subsidiary restriction section cooperating with a subsidiary restriction section of the reaction drum to together limit a rotational angle of the restriction unit within a certain range, the main body being formed with a protruding stop section positioned under the second stop section, and the protruding stop section extending toward the reference axis to a greater extent than either of the first and second stop sections.

8. The locking/unlocking structure of switch device as claimed in claim 6, wherein the main body, the reaction drum, and the restriction unit are positioned in an assembling position, a stop section of the restriction unit being correspondingly positioned relative to the first stop section of the main body, the first elastic unit being in a compressed state.

9. The locking/unlocking structure of switch device as claimed in claim 6, wherein the reaction drum is formed with at least one restriction section, the restriction unit including at least one restriction section for engaging with the restriction section of the reaction drum, at least one protruding stop section being disposed on an outer circumference of the restriction unit.

10. The locking/unlocking structure of switch device as claimed in claim 9, wherein the restriction unit is further formed with a protruding subsidiary restriction section cooperating with a subsidiary restriction section of the reaction drum to together limit a rotational angle of the restriction unit within a certain range, the main body being formed with a protruding stop section positioned under the second stop section, the protruding stop section extending toward the reference axis to a greater extent than either of the first and second stop sections.

11. A locking/unlocking structure of switch device, comprising: a main body having a reference axis extending axially therethrough, the main body including an assembling hole and a chamber in communication with the assembling hole, the main body being formed with at least one first stop section and at least one second stop section, a reaction drum assembled in the chamber of the main body, a first elastic unit disposed about the reaction drum, the reaction drum being assembled with a restriction unit and a second elastic unit, and responsive to movement of the reaction drum, the restriction unit is at least movable between the first stop section and the second stop section;

wherein multiple first stop sections and multiple second stop sections are formed in the main body and multiple passages in adjacency to at least one of the first and second stop sections are disposed in the chamber of the main body, each of the first stop sections being positioned closer to the assembling hole than a respective adjacent one of the second stop sections, each of the first and second elastic units having a first end and a second end, the first end of the first elastic unit being assembled with the reaction drum, the second end of the first elastic unit being affixed to the main body, the first end of the second elastic unit being affixed to the reaction drum, the second end of the second elastic unit being assembled with the restriction unit;

wherein the first and second stop sections are protruding board structures defining the corresponding passage on the main body, the reaction drum being formed with a pivotal connection hole and a hole positioned adjacent the pivotal connection hole and a belly section downward extending from the pivotal connection hole, the belly section being formed with a hole, at least one protruding restriction section being formed on the belly section, the first elastic unit being annularly disposed between the chamber of the main body and the reaction drum, the first end of the first elastic unit is assembled in the hole of the reaction drum and the second end of the first elastic unit is affixed in a recess of the main body, the second elastic unit being wound on the belly section of the reaction drum, the first end of the second elastic unit being affixed to the hole formed in the belly section of the reaction drum, the second end of the second elastic unit being assembled in a dent of the restriction unit, the restriction unit being formed with a shaft hole to be fitted on the reaction drum and rotated about the reaction drum.

12. The locking/unlocking structure of switch device as claimed in claim 11, wherein the restriction unit is further formed with a protruding subsidiary restriction section cooperating with a subsidiary restriction section of the reaction drum to together limit a rotational angle of the restriction unit within a certain range, the main body being formed with a protruding stop section positioned under the second stop section, the protruding stop section extending toward the reference axis to a greater extent than either of the first and second stop sections.

13. The locking/unlocking structure of switch device as claimed in claim 11, wherein the main body, the reaction drum, and the restriction unit are positioned in an assembling position, a stop section of the restriction unit being correspondingly positioned relative to the first stop section of the main body, the first elastic unit being in a compressed state, and the first and second elastic units respectively providing a torque.

14. The locking/unlocking structure of switch device as claimed in claim 11, wherein the restriction unit includes at least one restriction section for engaging with the restriction section of the reaction drum, at least one protruding stop section being disposed on an outer circumference of the restriction unit.

15. The locking/unlocking structure of switch device as claimed in claim 14, wherein the restriction unit is further formed with a protruding subsidiary restriction section cooperating with a subsidiary restriction section of the reaction drum to together limit a rotational angle of the restriction unit within a certain range, the main body being formed with a protruding stop section positioned under the second stop section, the protruding stop section extending toward the reference axis to a greater extent than either of the first and second stop sections.

16. The locking/unlocking structure of switch device as claimed in claim 11, wherein an operation button is disposed in the assembling hole of the main body, the operation button being configured to move and rotate within the main body along the reference axis, the dent of the restriction unit being positioned adjacent the shaft hole, a wire connection module being assembled in the chamber of the main body, a drive section of the operation button being pivotally connected in the pivotal connection hole of the reaction drum, the operation button driving the reaction drum to move to control the wire connection module into a closed-circuit state or an open-circuit state.

17. The locking/unlocking structure of switch device as claimed in claim 16, wherein the restriction unit is further formed with a protruding subsidiary restriction section cooperating with a subsidiary restriction section of the reaction drum to together limit a rotational angle of the restriction unit within a certain range, the main body being formed with a protruding stop section positioned under the second stop section, the protruding stop section extending toward the reference axis to a greater extent than either of the first and second stop sections.

18. The locking/unlocking structure of switch device as claimed in claim 16, wherein the main body, the reaction drum, and the restriction unit are positioned in an assembling position, a stop section of the restriction unit being correspondingly positioned relative to the first stop section of the main body, the first elastic unit being in a compressed state, and the first and second elastic units respectively providing a torque.

19. The locking/unlocking structure of switch device as claimed in claim 16, wherein the restriction unit includes at least one restriction section for engaging with the restriction section of the reaction drum, at least one protruding stop section being disposed on an outer circumference of the restriction unit.

20. The locking/unlocking structure of switch device as claimed in claim 19, wherein the restriction unit is further formed with a protruding subsidiary restriction section cooperating with a subsidiary restriction section of the reaction drum to together limit a rotational angle of the restriction unit within a certain range, the main body being formed with a protruding stop section positioned under the second stop section, the protruding stop section extending toward the reference axis to a greater extent than either of the first and second stop sections.

* * * * *